US009404629B2

(12) United States Patent
Krijn et al.

(10) Patent No.: US 9,404,629 B2
(45) Date of Patent: Aug. 2, 2016

(54) PATTERN-PROJECTING LIGHT-OUTPUT SYSTEM

(75) Inventors: Marcellinus Petrus Carolus Michael Krijn, Eindhoven (NL); Michel Cornelis Josephus Marie Vissenberg, Eindhoven (NL); Tim Dekker, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1069 days.

(21) Appl. No.: 13/256,235

(22) PCT Filed: Mar. 11, 2010

(86) PCT No.: PCT/IB2010/051047

§ 371 (c)(1),
(2), (4) Date: Dec. 28, 2011

(87) PCT Pub. No.: WO2010/103477

PCT Pub. Date: Sep. 16, 2010

(65) Prior Publication Data

US 2012/0092863 A1 Apr. 19, 2012

(30) Foreign Application Priority Data

Mar. 13, 2009 (EP) ..... 09155156

(51) Int. Cl.
*F21V 14/00* (2006.01)
*F21S 10/00* (2006.01)
(Continued)

(52) U.S. Cl.
CPC ..... *F21S 10/00* (2013.01); *F21V 5/002* (2013.01); *F21V 5/007* (2013.01); *F21V 5/008* (2013.01);
(Continued)

(58) Field of Classification Search
CPC ..... F21V 5/002; F21V 5/004; F21V 5/005; F21V 5/007; F21V 5/043; F21V 5/046; F21V 5/048
USPC ..... 362/227, 231
See application file for complete search history.

(56) References Cited

U.S. PATENT DOCUMENTS 1,880,026 A * 9/1932 Singerman ..... 434/102
4,641,446 A * 2/1987 Jackson ..... 40/444
(Continued)

FOREIGN PATENT DOCUMENTS

EP 0992838 A2 4/2000
JP 2000-200052 7/2000
(Continued)

OTHER PUBLICATIONS

Office Action issued by the JPO dated Feb. 3, 2015, cited in related Japanese Patent Application No. 2011-553588.

*Primary Examiner* — Anabel Ton
(74) *Attorney, Agent, or Firm* — Meenakshy Chakravorty

(57) ABSTRACT

A light-output system (1), for forming a controllable pattern (10) of illuminated spots (11*a-b*) in a distant projection plane (3). The light-output system (1) comprises a plurality of individually controllable light-output devices (6*a-c*) arranged in an array (5) of light-output devices with a light-output device pitch ($P_{LS}$), and an optical system (7) arranged between the array (5) of light-output devices and the projection plane (3). The optical system (1) is configured to project light emitted by the array (5) of light-output devices in the projection plane (5) as a projected array of illuminated spots (11*a-c*) having a projection pitch ($P_{spot}$) that is larger than the light-output device pitch ($P_{LS}$). Using this light-output system, practically all of the luminous power output by the light-output devices is used for projecting the light patterns.

13 Claims, 4 Drawing Sheets

(51) Int. Cl.

| | |
|---|---|
| ***F21V 5/00*** | (2015.01) |
| *F21Y 101/02* | (2006.01) |
| *F21Y 105/00* | (2016.01) |
| *F21V 5/02* | (2006.01) |
| *F21V 5/04* | (2006.01) |

(52) U.S. Cl.
CPC .. *F21V 5/02* (2013.01); *F21V 5/048* (2013.01); *F21Y 2101/02* (2013.01); *F21Y 2105/001* (2013.01)

(56) References Cited

U.S. PATENT DOCUMENTS

| | | | | |
|---|---|---|---|---|
| 5,612,821 | A | 3/1997 | Schmutz | |
| 5,722,760 | A * | 3/1998 | Chien | 362/84 |
| 6,318,863 | B1 * | 11/2001 | Tiao et al. | 353/31 |
| 6,412,953 | B1 * | 7/2002 | Tiao et al. | 353/98 |
| 6,520,666 | B1 * | 2/2003 | Beyerlein et al. | 362/471 |
| 6,554,451 | B1 * | 4/2003 | Keuper | 362/237 |
| 6,955,449 | B2 * | 10/2005 | Martineau | 362/246 |
| 7,147,351 | B2 * | 12/2006 | Suzuki | 362/351 |
| 7,931,517 | B2 * | 4/2011 | Yang et al. | 445/24 |
| 8,262,252 | B2 * | 9/2012 | Bergman et al. | 362/237 |
| 2002/0126479 | A1 * | 9/2002 | Zhai et al. | 362/244 |
| 2004/0036990 | A1 | 2/2004 | Hanano | |
| 2004/0041984 | A1 * | 3/2004 | Tani et al. | 353/20 |
| 2004/0130891 | A1 * | 7/2004 | Twardawski | 362/157 |
| 2005/0057933 | A1 * | 3/2005 | Suzuki | 362/351 |
| 2005/0201109 | A1 * | 9/2005 | Shimura | 362/382 |
| 2005/0205878 | A1 * | 9/2005 | Kan | 257/80 |
| 2007/0031097 | A1 * | 2/2007 | Heikenfeld et al. | 385/129 |
| 2007/0147041 | A1 * | 6/2007 | Shiratsuchi et al. | 362/268 |
| 2008/0062682 | A1 * | 3/2008 | Hoelen et al. | 362/231 |
| 2008/0239726 | A1 | 10/2008 | Cheng | |
| 2008/0304263 | A1 * | 12/2008 | Paulussen | 362/235 |

FOREIGN PATENT DOCUMENTS

| | | | |
|---|---|---|---|
| JP | 2000200052 | A | 7/2000 |
| JP | 2005-206133 | | 8/2005 |
| JP | 2005206133 | A | 8/2005 |
| JP | 2005-285697 | | 10/2005 |
| JP | 2005285697 | A | 10/2005 |
| JP | 2005-352205 | | 12/2005 |
| JP | 2005352205 | A | 12/2005 |
| JP | 2008-103300 | | 5/2008 |
| JP | 2008103300 | A | 5/2008 |
| JP | 2009-501418 | | 1/2009 |
| WO | 2006105396 | A1 | 10/2006 |
| WO | 2007007271 | A2 | 1/2007 |
| WO | 2008142621 | A1 | 11/2008 |

* cited by examiner

PATTERN-PROJECTING LIGHT-OUTPUT SYSTEM

FIELD OF THE INVENTION

The present invention relates to a light-output system for forming a controllable pattern of illuminated spots in a distant projection plane.

BACKGROUND OF THE INVENTION

With the ongoing progress in the development of new light-sources, such as new and improved light-emitting diodes (LEDs), new areas of applications have emerged. For example, products have been developed that enable a user to create atmospheres using controllable lighting. One example of such a product is the LivingColours lamp from Philips which, through its intuitive remote control, gives the user the freedom to discover an infinite range of colors.

As a further step, it would be desirable to enable the user to control further aspects of lighting, such as forming controllable light patterns on a wall or similar.

Existing devices, such as electronic projectors, can be used to form such controllable patterns. However, only a small fraction of the light generated by the light-source in such devices—typically as small a fraction as 5%—is in fact used for creating the pattern.

SUMMARY OF THE INVENTION

In view of the above-mentioned and other drawbacks of the prior art, a general object of the present invention is to provide an improved light-output system enabling the formation of controllable light patterns on a wall or similar with a higher luminous efficiency than existing electronic projection devices.

Accordingly, the invention provides a light-output system, for forming a controllable pattern of illuminated spots in a distant projection plane, the light-output system comprising: a plurality of individually controllable light-output devices arranged in an array of light-output devices with a light-output device pitch; and an optical system arranged between the array of light-output devices and the projection plane, the optical system being configured to project light emitted by the array of light-output devices in the projection plane as a projected array of illuminated spots with a one-to-one relation to the light-output devices, the projected array having a projection pitch being larger than the light-output device pitch.

The term "light-output device" should, in the context of the present application, be understood to refer to any device capable of outputting light, that is, electromagnetic radiation within the visible spectrum.

The "pitch" of an array refers to the distance between adjacent devices comprised in the array in one of the principal directions of the array. As is understood by the person skilled in the art, a one-dimensional array has one pitch value and a two-dimensional array has two pitch values, which may or may not be equal.

The present invention is based on the realization that controllable light patterns can be projected on a wall or similar with a very high luminous efficiency by generating the pattern to be projected using an array of light-output devices and projecting the individual light-output devices to corresponding spots on the wall or similar, the pitch of the array of spots being larger than the pitch of the array of light-output devices.

The projected array of illuminated spots may advantageously comprise the same number of array elements as the array of light-output devices.

Using the light-output system according to the present invention, practically all of the luminous power output by the light-output devices is used for projecting the light patterns. This results in a dramatically improved luminous efficiency of the light-output system as compared to prior art systems relying upon light being modulated by a spatial light modulator or similar.

Furthermore, the optical system according to the invention can be made very compact and cost-efficient, since only an array of light-output devices and an optical system without moving parts and/or individually controllable elements are needed to achieve the desired controllable patterns of projected light.

The optical system arranged between the array of light-output devices and the projection plane may advantageously comprise an array of optical elements having an optical element pitch.

Moreover, the optical elements may be focusing lenses. The focusing lenses may advantageously have substantially identical focusing properties.

According to one embodiment, the optical element pitch of the array of optical elements may be larger than the light-output device pitch and smaller than the projection pitch. With such a configuration, the projected array of illuminated spots having a projection pitch being larger than the light-output device pitch can be achieved without the aid of any additional optical arrangements.

Since the distance between the projection surface and the optical elements is typically considerably larger than the distance between the light-output devices and the optical elements, the optical element pitch may advantageously be larger than the light-output device pitch by a factor ranging between 1 and 1.25, and more advantageously by a factor ranging between 1.05 and 1.18. In other words, the optical element pitch may be related to the light-output device pitch according to the following relation:

$$P_{optical\ element}=\alpha P_{light\text{-}output\ device},$$

where $P_{optical\ element}$ is the optical element pitch; $P_{light\text{-}output\ device}$ is the light-output device pitch, and $\alpha$ is the above-mentioned factor.

To ensure that the light output by each of the light-output devices in the array of light-output devices is projected by its associated optical element in the optical element array, the number of optical elements in the optical element array may advantageously fulfill the following relation:

$$N(P_{optical\ element}-P_{light\text{-}output\ device})<P_{optical\ element},$$

where:

N is the largest dimension of the optical element array in any direction;

$P_{optical\ element}$ is the optical element pitch; and $P_{light\text{-}output\ device}$ is the light-output device pitch.

Furthermore, each light-output device may comprise at least a first light-source and a second light-source configured to emit differently colored light. This enables projection of colored patterns.

Advantageously, a first light-source comprised in a first light-output device may be arranged in relation to the optical element associated with the first light-output device in such a way that light emitted by the first light-source is projected as a spot associated with a second light-source comprised in a second light-output device. The second light-output device may be located adjacent to the first light-output device, or the first and second light-output devices may be spaced apart by one or several other light-output devices.

This light-output device configuration enables controlling the color of a projected spot through mixing of light output by light-sources comprised in different light-output devices.

Moreover, first and second adjacent light-sources comprised in a given light-output device may be spaced apart by a distance $\Delta_{LS}$ given by the relation:

$$\Delta_{LS} = n\frac{z_o}{z_i}P_{Spot},$$

where n is an integer 1, 2, 3, . . . , $z_i$ is the optical distance between the optical element associated with the light-output device and the projection plane, $z_o$ is the optical distance between the light-output device and the optical element, and $P_{spot}$ is the projection pitch. As is well known to the skilled person, the "optical distance" is the physical distance times the refractive index of the medium through which the light travels.

Hereby, substantially complete overlap between differently colored sub-spots can be achieved, whereby artifacts, such as colored fringes can be avoided.

According to a further embodiment, the optical system may additionally comprise a beam-directing member arranged between the array of optical elements and the projection plane, the beam-directing member being configured to direct light-beams exiting from the array of optical elements towards the projected array of illuminated spots in the projection plane.

With a beam-directing member arranged between the array of optical elements and the projection plane, the difference between the optical element pitch and the output element pitch can be made smaller (the optical element pitch and the output element pitch can even be equal), whereby a larger array of optical elements (light-output devices) can be accommodated, which enables higher resolution and/or the formation of a larger projected pattern at a given distance.

The beam-directing member may comprise an array of directing optical elements, each being configured to direct a light-beam exiting from an associated optical element in the array of optical elements towards an associated spot in the projected array of illuminated spots in the projection plane.

Alternatively or in combination with the above-described beam-directing member being arranged between the array of optical elements and the projection plane, the light-output system according to various embodiments of the invention may comprise a beam-directing member arranged between the array of light-output devices and the array of optical elements. This beam-directing member may comprise an array of directing optical element in analogy with what is described above.

Moreover, the light-output system may advantageously be configured to enable relative movement between the array of light-output devices and the optical system. According to this embodiment, the position one of or both of the array of light-output devices and the optical system may be adjustable. Hereby, the configuration of the projected spots can be adjusted by the user in accordance with the conditions at the location of application of the light-output system.

For example, the light-output system may be configured to enable adjustment of a distance between the array of light-output devices and the optical system. Hereby, the light-output system can be adapted for different distances to the surface onto which the pattern should be projected and/or different desired overlaps between adjacent spots on the surface.

Moreover, the alignment between the array of light-output devices and the optical system may be adjustable, that is, either or both of the array of light-output devices and the optical system may be moveable in a sideways direction, whereby the user can adjust the location of the projected pattern of illuminated spots, while the light-output system remains stationary.

Furthermore, the light-output system may comprise partitioning walls separating the light-output devices, the partitioning walls being arranged between the array of light-output devices and the optical system. Hereby, it can be prevented that the direction of light output by a given light-output device is modified by an optical element which is not associated by that light-output device.

BRIEF DESCRIPTION OF THE DRAWINGS

These and other aspects of the present invention will now be described in more detail, with reference to the appended drawings showing currently preferred embodiments of the invention, wherein.

DESCRIPTION OF A PREFERRED EMBODIMENT OF THE PRESENT INVENTION

In the following description, the present invention is mainly described with reference to a light-output system, in which the light-output devices comprise a plurality of differently colored light-emitting diodes (LEDs), and an array of conventional positive lenses.

It should be noted that this by no means limits the scope of the invention, which is equally applicable to light-output systems comprising other types of light-output devices, as well as other optical elements, such as fresnel lenses etc.

Figure 1:
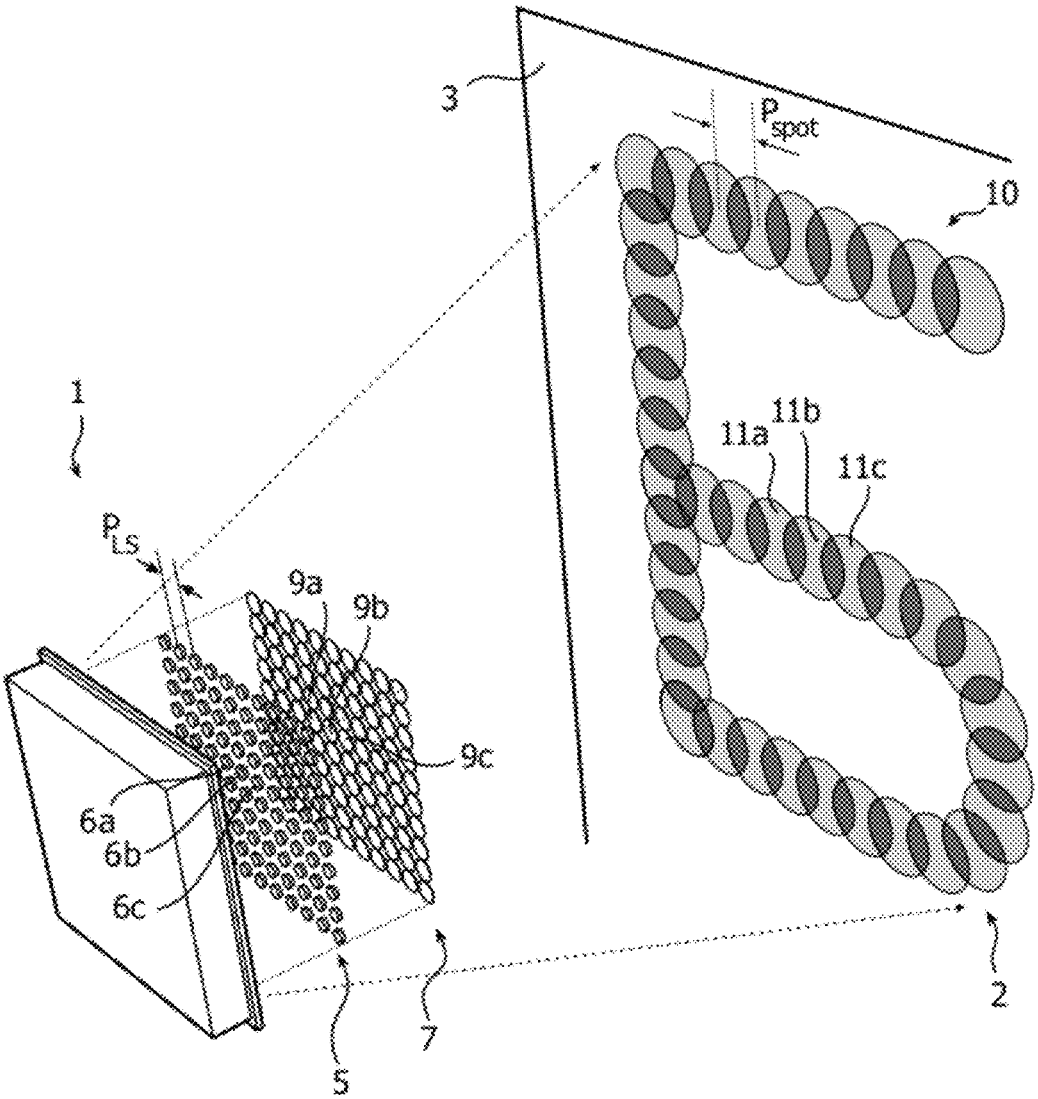
FIG. 1 schematically illustrates an exemplary light-output system projecting a light pattern on a wall.

FIG. 1 is an exploded view, schematically illustrating an exemplary light-output system 1 projecting a pattern 2 on a distant wall 3 representing a projection plane. Referring to FIG. 1, the light-output system 1 comprises an array 5 of individually controllable light-output devices 6*a-c* (only three of these are indicated using reference numerals to avoid cluttering the drawing) and an optical system 7 comprising an array of optical elements 9*a-c* arranged between the light-output devices 6*a-c* and the projection plane 3.

Furthermore, as is schematically illustrated in FIG. 1, light output by the array 5 of light-output devices 6*a-c* is projected as a projected array 10 of illuminated spots 11*a-c*. The pitch (distance between neighboring light-output devices) $P_{LS}$ of the array 5 of light-output devices 6*a-c* is, as can be seen in FIG. 1, considerably smaller than the pitch $P_{spot}$ of the illuminated spots 11*a-c* in the projection plane 3. The translation from the light-output device pitch $P_{LS}$ to the pitch $P_{spot}$ of the illuminated spots 11*a-c* is taken care of by the optical system 7 arranged between the array 5 of light-output devices 6*a-c* and the projection plane 3, and will be further described below with reference to a number of illustrative embodiments of the light-output system in FIG. 1.

A first embodiment of the light-output system having the basic configuration illustrated in FIG. 1 will now be described with reference to FIG. 2.

Figure 2:
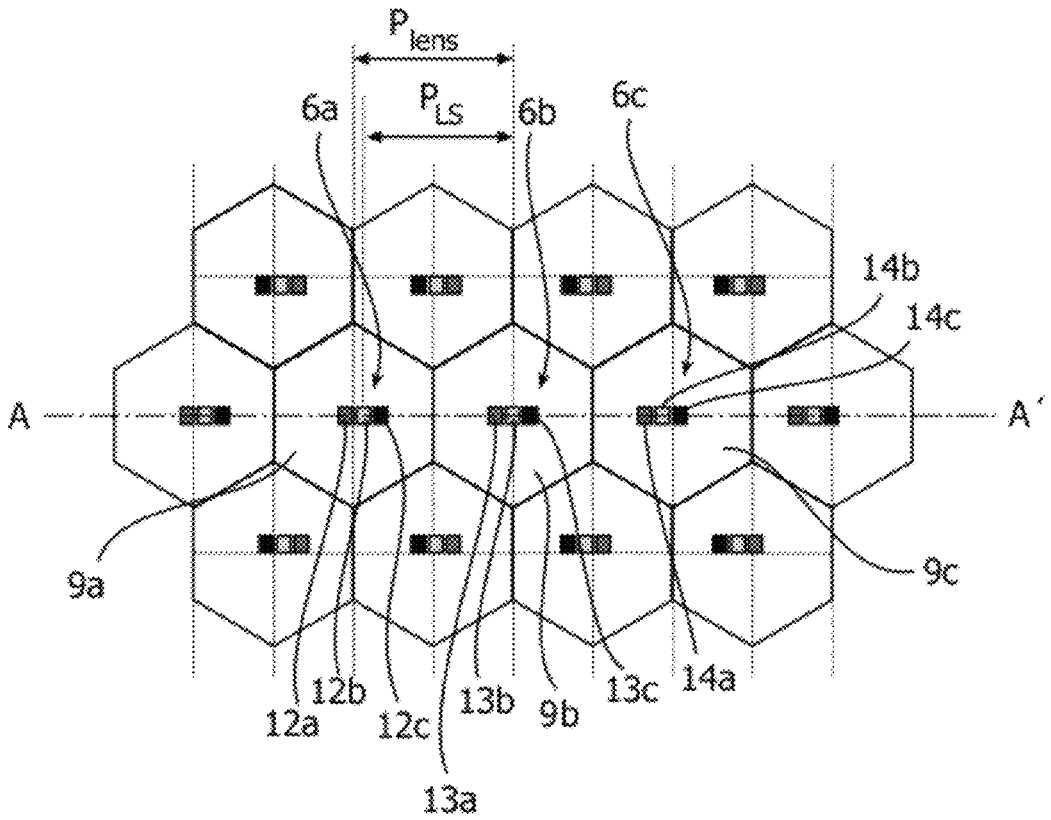
FIG. 2 is a schematic representation of a portion of the light-output system in FIG. 1, illustrating one possible configuration thereof.

FIG. 2 is a plane view of the light-output system 1 seen from the projection plane 3 in FIG. 1, and light-output devices 6*a-c* are visible through the optical elements 9*a-c*. In this particular embodiment, each light-output device 6*a-c* comprises a blue LED 12*a*, 13*a*, 14*a*, a red LED 12*b*, 13*b*, 14*b*, and a green LED 12*c*, 13*c*, 14*c*, and the optical elements 9*a-c* are provided in the form of lenses arranged with a pitch P-lens which is larger than the light-output device pitch $P_{LS}$. Although, the embodiment illustrated in FIG. 2 is a color controllable embodiment, the principle of the translation from the light-output device pitch $P_{LS}$ to the pitch $P_{spot}$ of the illuminated spots 11*a-c* in FIG. 1 will first be described with reference to a simplified monochrome case which is schematically illustrated in FIG. 3, and which corresponds to the configuration of FIG. 2 with the red LEDs 12*b*, 13*b*, 14*b* only.

Figure 3:
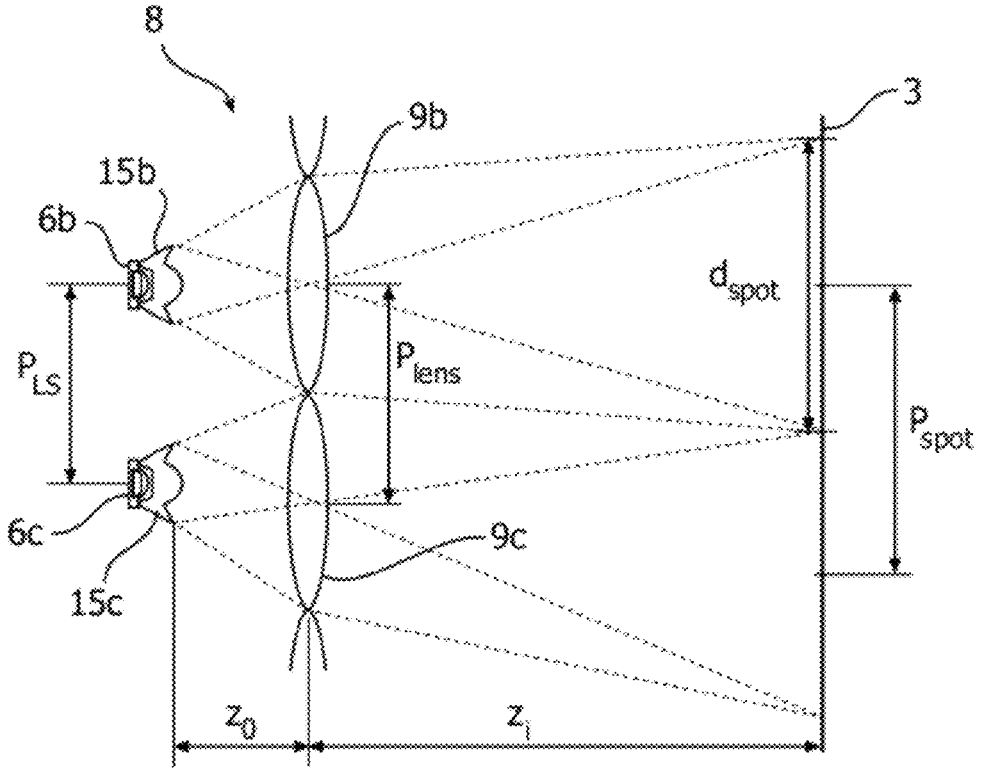
FIG. 3 is a section of a simplified representation of the partial light-output system in FIG. 2 along the line A-A', illustrating the geometry of the light-output system.

With reference to FIG. 3, the relations between the geometric properties of the present embodiment of the light-output system 1 will now be described. In the embodiment schematically illustrated in FIG. 3, the optical elements 9*b-c* are arranged at an optical distance $z_o$ from the light-sources 6*b-c*, and the projection plane 3 is located at an optical distance $z_i$ from the optical elements 9*b-c*. As is indicated in FIG. 3, each light-source 6*b-c* may be equipped with collimating optics 15*b-c* to collimate the light emitted by the light-sources 6*b-c* somewhat. This is done to ensure that most of the light emitted by the light-sources 6*b-c* can be captured by the corresponding lens 9*b-c*.

Now, in the embodiment that is schematically illustrated in FIG. 3, the translation from the light-source pitch $P_{LS}$ to the pitch $P_{spot}$ of the illuminated spots in the projection plane 3 is achieved by suitably selecting the geometry of the system, that is, for a given light-source pitch $P_{LS}$, suitably selecting the distance $z_o$ between the light-sources 6*b-c* and the lenses 9*b-c* and the pitch $P_{lens}$ of the lenses 9*b-c* in the lens array 8.

In particular, the configuration of the optical system according to the presently illustrated embodiment should fulfill the following relation:

$$P_{LS} = P_{Lens} - \frac{z_o}{z_i}(P_{Spot} - P_{Lens}). \tag{1}$$

Since in practice $P_{Spot} \gg P_{Lens}$, equation (1) implies that $P_{LS}$ is smaller than $P_{Lens}$. Preferably, $0.8\ P_{Lens} < P_{LS} < P_{Lens}$. Even more preferred is $0.85\ P_{Lens} < P_{LS} < 0.95\ P_{Lens}$. Note also that $z_o \ll z_i$.

The size of the spots projected on the wall, $d_{Spot}$, is typically equal to the magnification factor of the system times the dimension of the light-source 6*a-b* (plus the collimator 15*b-c* if applicable), $d_{LS}$:

$$d_{Spot} = \frac{z_i}{z_o} d_{LS}. \tag{2}$$

To ensure smooth transitions in intensity and color in the pattern 2 (FIG. 1) being projected in the projection plane 3, a certain overlap between neighboring dots 11*a-c* (FIG. 1) is desirable. This overlap follows from the relation:

$$O = \frac{d_{Spot} - P_{Spot}}{d_{Spot}} \times 100\%. \tag{3}$$

It has been found that an overlap O>25% gives the desired smooth transitions. Furthermore, to maintain the ability to discern neighboring dots 11*a-c*, (prevent loss of resolution of the light pattern 2 projected onto the wall 3) the overlap may have an upper limit, which may advantageously be O<75%.

It should be noted that extra overlap can be created by locating a further optical element (not shown in FIG. 3), such as a diffuser (or an array of weak and fine-pitched lenses) close to the plane of the lenses.

Having now explained the geometry of one exemplary embodiment of the light-output system 1 whereby the desired translation between the pitch $P_{LS}$ of the light-output devices 6*a-c* and the pitch $P_{spot}$ of the spots 11*a-c* projected in the projection plane 3 can be achieved, we will now move on to describe how the configuration of FIG. 3 can be modified to enable the formation of colored projected patterns.

Figure 4:
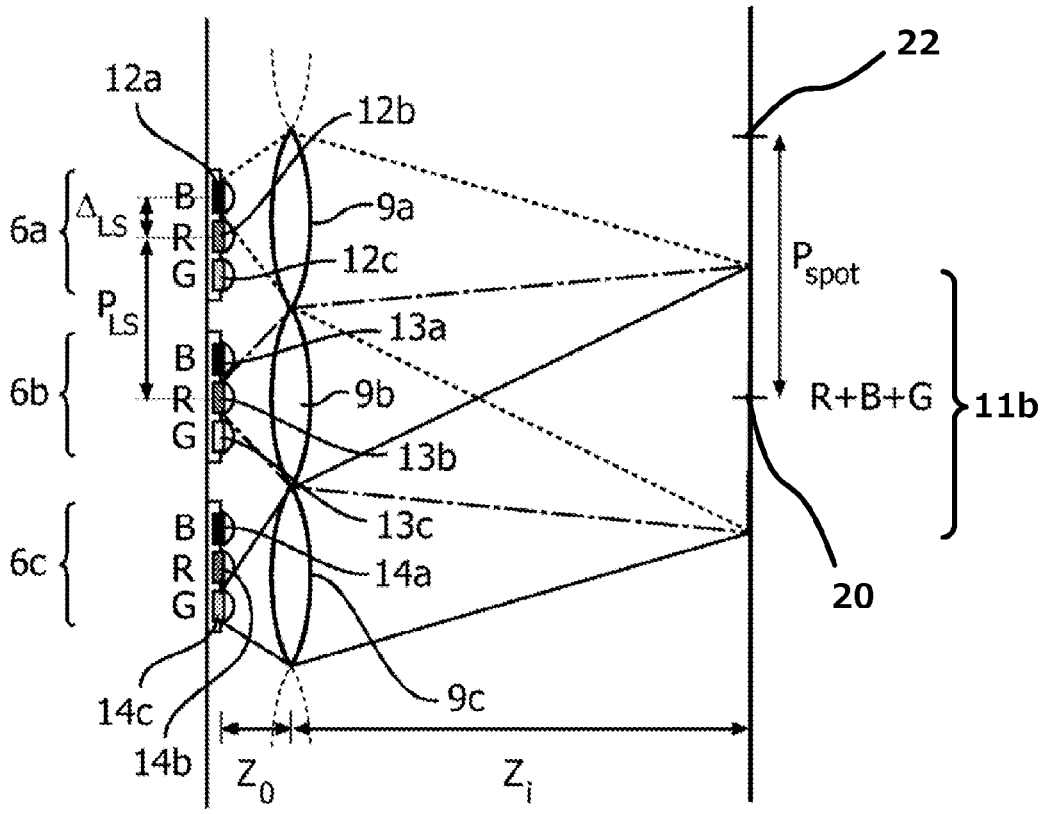
FIG. 4 is a section view of the partial light-output system in FIG. 2 along the line A-A', illustrating how differently colored spots can be formed.

FIG. 4 is a section view of the partial light-output system in FIG. 2 along the line A-A', illustrating how differently colored spots can be formed using the light-output system in FIG. 1.

To achieve a high quality pattern with colored illuminated spots 11*a-c*, it is desirable to ensure that spots of basic colors are projected in the projection plane 3 in such a way that they substantially fully overlap. In this manner, spots of virtually freely controllable colors can be formed without artifacts such as colored fringes etc.

Referring to FIG. 4, an exemplary embodiment will now be described, in which the system is based on three primary colors, red (=R), green (=G), and blue (=B). Behind (as seen from the projection plane 3) each lens 11*a-c*, a triplet of RGB-LEDs 12*a-c*, 13*a-c*, 14*a-c* is located. The light emitted by each LED of these triplets results in a spot of light on the wall 3, as is schematically illustrated in FIG. 4 for the blue LED 12*a*, the red LED 13*b*, and the green LED 14*c*. The resulting spot 11*b* will appear white. The pitch $P_{spot}$ is delineated by point 20 of spot 11*b* and point 22 of a neighboring spot.

To ensure that the illuminated spots resulting from different light-sources comprised in different light-output devices 6*a-c* (here LED-triplets) overlap, a suitable spacing between the light-sources comprised in the light-output devices 6*a-c* should be selected.

Referring to the exemplary embodiment in FIG. 4, it can be ensured that each LED of a certain color results in a spot of light on the wall that fully overlaps with the light of a LED of a complementary color of a another triplet by arranging the LEDs 12*a-c*, 13*a-c*, 14*a-c* within each triplet 6*a-c* with a suitable spacing. This spacing distance follows from the relation:

$$\Delta_{LS} = n\frac{z_o}{z_i} P_{Spot}. \tag{4}$$

In this relation, n is an integer indicating the distance, in units of the spot pitch $P_{spot}$, between spots resulting from projection of light output by neighboring light-sources in a light-output device 6*a-c*. Advantageously, the spacing distance $\Delta_{LS}$ may be selected such that n=1 in the above relation. In case one is not able to position differently colored light-sources that close together, one can opt for n=2 or n=3.

It should be note that the differently colored light-sources 12*a-c*, 13*a-c*, 14*a-c* may be provided as separate devices or may be packaged together in one and the same housing.

Figure 5:
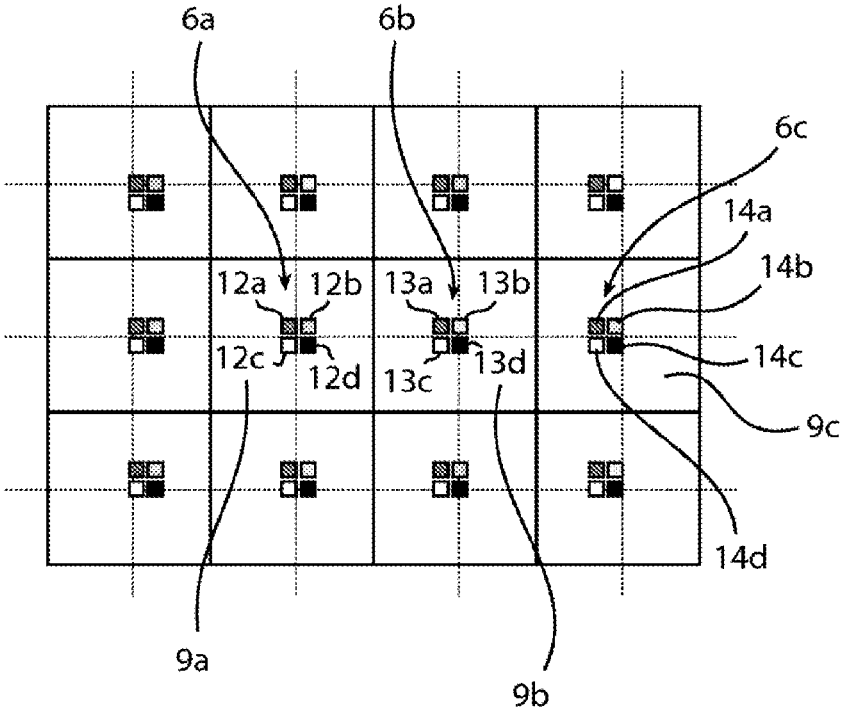
FIG. 5 is a schematic representation of a portion of the light-output system in FIG. 1, illustrating another possible configuration thereof.

As an alternative to the hexagonal arrangement of the light-output devices illustrated in FIG. 2, the light-output devices 6*a-c* may be arranged in a rectangular configuration, as is schematically illustrated in FIG. 5.

The configuration in FIG. 5 also differs from that described above with reference to FIG. 2 in that each light-output device 6*a-c* comprises four light-sources 12*a-d*, 13*a-d*, 14*a-d*, where the fourth light-source is a light-source configured to emit white light to achieve improved illumination.

It should be noted that, just as was the case for the embodiment illustrated in FIG. 2, the pitch of the optical elements 9*a-c* is larger than the pitch of the light-output devices 6*a-c* in both the horizontal and the vertical direction.

Figure 6:
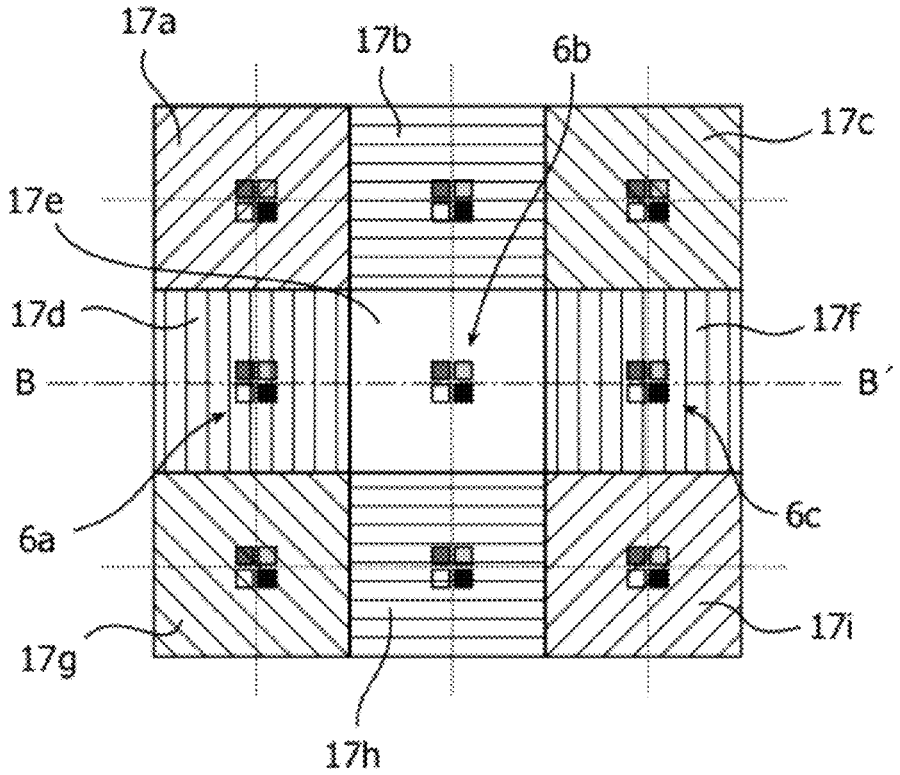
FIG. 6 is a schematic representation of a portion of the light-output system in FIG. 1, illustrating yet another possible configuration thereof, including a beam-directing member being arranged between the optical element array and the projection plane.
Figure 7:
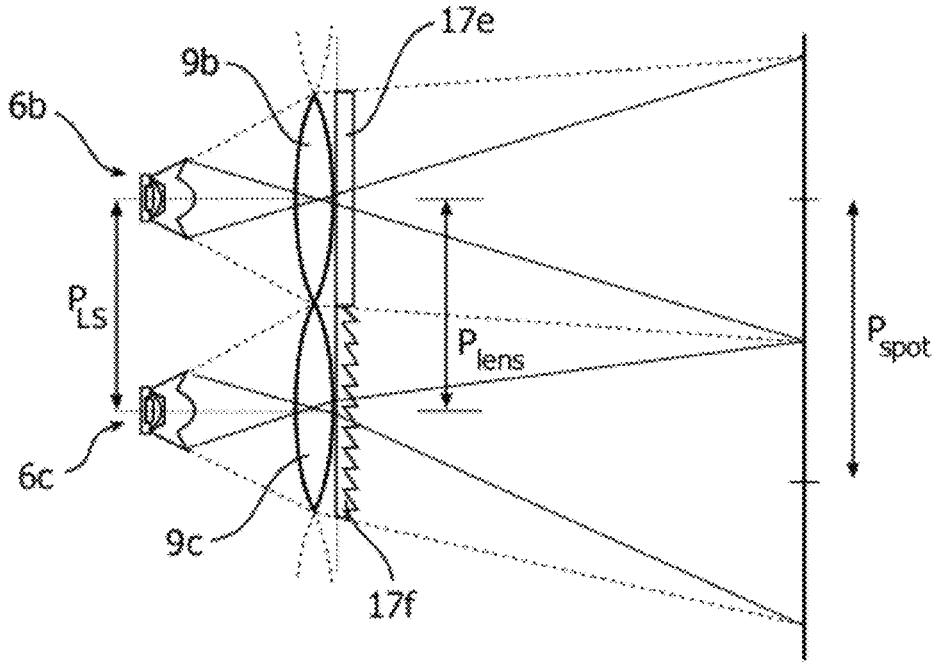
FIG. 7 is a section view of the partial light-output system in FIG. 6 along the line B-B'.

Next, with reference to FIGS. 6 and 7, we will discuss yet another possible configuration useable in various embodiments of the light-output system 1 in FIG. 1.

According to the various configurations discussed so far, the translation from the light-output device pitch $P_{LS}$ to the pitch $P_{spot}$ of the illuminated spots 11*a-c* projected in the projection plane 3 has been achieved by selecting a suitable pitch $P_{lens}$ of an array of lenses arranged between the array 5 of light-output devices 6*a-c* and the projection plane 3.

As an alternative or complement, the light-output system 1 may be provided with a beam-directing member arranged between the array of optical elements 9*a-c* and the projection plane 3 to direct the light beams having passed through the optical elements 9*a-c* to achieve illuminated spots 11*a-c* with the desired pitch $P_{spot}$ in the projection plane 3.

For example, as is schematically illustrated in FIG. 6, the pitch $P_{lens}$ of the optical elements 9*a-c* can be selected to be the same as the pitch $P_{LS}$ of the light-output devices 6*a-c*, and a beam-directing member be arranged between the optical elements 9*a-c* and the projection plane 3 to achieve substantially all of the translation from $P_{LS}$ to $P_{spot}$.

It will be appreciated by the skilled person that the magnitude and direction of the beam deflection brought about by the beam-directing member will depend on the location in the array, and that the beam-directing member should, in the case illustrated in FIG. 6, be configured in such a way that, when tracing back the rays from the outside of the light-output system 1 through the beam-directing member and the array of optical elements 9*a-c* towards the light-output devices 6*a-c*, the light-output devices 6*a-c* appear to be spaced at a pitch $P_{LS}$ given by equation (1).

An example of a simple beam-directing member schematically illustrated in the exemplary configuration of FIG. 6 is based on a fine-pitched one-dimensional array of prisms 17*a-i*. The beam-directing member may comprise a plurality of optical elements, or may be provided as one large overall beam-directing member, which may, for example, be a large negative lens, preferably a Fresnel-type lens.

In FIG. 7, which is a section view of the partial light-output system in FIG. 6 along the line B-B', the principle of post-deflection is schematically illustrated for the simplified case with monochrome light-output devices 6*a-b*. Through the configuration in FIG. 7, the same spot pitch $P_{spot}$ is achieved for the same optical element pitch $P_{lens}$ as in FIG. 3.

Finally, it should be noted that various measures may be taken to avoid boundary effects in color controllable embodiments of the light-output system 1 according to the present invention. According to one approach, the light-sources close to the edges of the array 5 of light-output devices, which cannot be complemented with the other colors needed to provide the full spectrum of colors for that spot location on the wall may be controlled not to emit light, or may be omitted from the light-output system 1.

The person skilled in the art will realize that the present invention is by no means limited to the preferred embodiments. For example, partitioning walls (absorbing) may be placed between neighboring light-output devices 6*a-c*, to ensure that the light emitting by a particular light-output device can only travel through the corresponding lens and not through a neighboring lens. Moreover, in case one wants to project a pattern on the wall from an oblique angle, it may be advantageous to have a smaller than average distance between the light-output devices and the optical elements for the spots projected close to the light-output system and have a larger than average distance between the light-output devices and the optical elements for the spots projected further from the light-output system. Furthermore, Fresnel-type lenses, being strong (high magnifying power) yet light-weight lenses, may advantageously be used as the optical elements. Additionally, some or all of the optical elements comprised in the light-output system may advantageously be electrically adjustable active optical elements based on for example liquid-crystals or electro-wetting. For example, by using an active diffuser, one can tune the overlap of the spots of light on the wall. By using an active post-deflector one is able to tune the size of the pattern of spots of light on the wall.

The invention claimed is:

1. A light-output system, for forming a controllable pattern of illuminated spots in a distant projection plane, said light-output system comprising:

a plurality of individually controllable light-output devices arranged in an array of light-output devices with a light-output device pitch, wherein each individually controllable light-output device comprises a plurality of light-sources; and an optical system arranged between said array of light-output devices and said projection plane, said optical system being configured to project light emitted by said array of light-output devices in said projection plane as a projected array of the illuminated spots having a projection pitch being larger than said light-output device pitch;

wherein each of a first device and a second device of said individually controllable light-output devices includes at least a respective first light-source configured to emit light having a first characteristic and a respective second light-source configured to emit light having a second characteristic that is different from said first characteristic;

wherein said system is configured such that a majority of a first light spot having said first characteristic formed by said first light-source of said first device and a majority of a second light spot having said second characteristic formed by said second light-source of said second device overlap on said projection plane to form one of the illuminated spots wherein the plurality of light-sources in a given one of the plurality of light-output devices are spaced apart by a distance $\Delta_{LS}$:

$$\Delta_{LS} = n\frac{z_o}{z_i}P_{Spot},$$

where n is an integer 1, 2, 3, . . . , and $z_i$ is the optical distance between an optical element of said array of optical elements, $z_o$ is the optical distance between said given light-output device and said associated optical element, and $P_{spot}$ is said projection pitch.

2. The light-output system according to claim 1, wherein said optical system comprises an array of optical elements having an optical element pitch.

3. The light-output system according to claim 2, wherein said optical elements are focusing lenses.

4. The light-output system according to claim 2, wherein said optical element pitch is larger than said light-output device pitch and smaller than said projection pitch.

5. The light-output system according to claim 4, wherein said optical element pitch is larger than said light-output device pitch by a factor ranging between 1 and 1.25.

6. The light-output system according to claim 2, wherein said optical system further comprises a beam-directing member arranged between said array of optical elements and said projection plane, said beam-directing member being configured to direct light-beams exiting from said array of optical elements towards said projected array of illuminated spots in said projection plane.

7. The light-output system according to claim 2, wherein said optical system further comprises a beam-directing member arranged between said array of light-output devices and said array of optical elements, said beam-directing member being configured to direct light-beams emitted by said light-output devices towards said projected array of illuminated spots in said projection plane.

8. The light-output system according to claim 6, wherein said beam-directing member comprises an array of directing optical elements, each being configured to direct a light-beam emitted by an associated light-output device in said array of light-output devices towards an associated spot in said projected array of illuminated spots in said projection plane.

9. The light-output system according to claim 1, configured to enable relative movement between said array of light-output devices and said optical system.

10. The light-output system according to claim 9, configured to enable adjustment of a distance between said array of light-output devices and said optical system.

11. The light-output system according to claim 1, wherein said first characteristic is a first color and said second characteristic is a second color.

12. The light-output system according to claim 11, wherein said first light spot and said second light spot essentially fully overlap to form said one of the illumination spots.

13. The light-output system according to claim 11, wherein said optical system includes a first optical element that is arranged primarily in front of said first device and is configured to project light having said first characteristic from said first device to form said first light spot, and wherein said optical system includes a second optical element that is arranged primarily in front of said second device and is configured to project light having said second characteristic from said second device to form said second light spot.

* * * * *